US009207010B2

(12) United States Patent
Jung et al.

(10) Patent No.: US 9,207,010 B2
(45) Date of Patent: Dec. 8, 2015

(54) REFRIGERATOR

(71) Applicant: LG ELECTRONICS INC., Seoul (KR)

(72) Inventors: Wonyeong Jung, Seoul (KR); Deokhyun Youn, Seoul (KR)

(73) Assignee: LG Electronics Inc., Seoul (KR)

( * ) Notice: Subject to any disclaimer, the term of this patent is extended or adjusted under 35 U.S.C. 154(b) by 82 days.

(21) Appl. No.: 13/665,057

(22) Filed: Oct. 31, 2012

(65) Prior Publication Data

US 2013/0105496 A1 May 2, 2013

(30) Foreign Application Priority Data

Nov. 2, 2011 (KR) ..... 10-2011-0113416

(51) Int. Cl.
*F25D 23/06* (2006.01)

(52) U.S. Cl.
CPC ..... *F25D 23/062* (2013.01); *F25D 2201/14* (2013.01)

(58) Field of Classification Search
CPC ... F25D 23/062; F25D 23/063; F25D 23/065; F25D 23/067
USPC ..... 312/400, 401, 406, 406.1, 409; 220/592.1, 592.01, 592.02, 592.09; 62/440; 52/406.2, 407.1
See application file for complete search history.

(56) References Cited

U.S. PATENT DOCUMENTS

| | | | | |
|---|---|---|---|---|
| 1,518,668 | A | 12/1924 | Mitchell | |
| 1,541,945 | A | 6/1925 | Hamilton | |
| 1,561,769 | A * | 11/1925 | Ballew | 220/592.05 |
| 1,588,707 | A * | 6/1926 | Csiga | 220/592.05 |
| 1,747,969 | A | 2/1930 | Carrey | |
| 1,770,200 | A * | 7/1930 | Comstock | 52/576 |
| 1,833,633 | A | 11/1931 | Light | |
| 2,044,600 | A | 6/1936 | Williams | |
| 2,196,373 | A | 4/1940 | Wallach | |
| 2,773,362 | A | 12/1956 | Scheitlin | |
| 3,161,265 | A | 12/1964 | Matsch | |
| 4,036,617 | A | 7/1977 | Leonard | |
| 4,147,037 | A | 4/1979 | Gelbard | |
| 4,301,658 | A | 11/1981 | Reed | |
| 4,526,015 | A | 7/1985 | Laskaris | |
| 4,959,111 | A | 9/1990 | Kruck | |
| 5,081,761 | A | 1/1992 | Rinehart | |

(Continued)

FOREIGN PATENT DOCUMENTS

| | | | |
|---|---|---|---|
| CN | 85106738 | A | 6/1986 |
| CN | 2033487 | U | 3/1989 |

(Continued)

OTHER PUBLICATIONS

U.S. Office Action dated Jan. 28, 2014 for U.S. Appl. No. 13/654,566, 18 pages.

(Continued)

*Primary Examiner* — James O Hansen
(74) *Attorney, Agent, or Firm* — Fish & Richardson P.C.

(57) ABSTRACT

There is disclosed a refrigerator including an inner case that defines an exterior appearance of a storage space, an outer case spaced apart a predetermined distance from the inner case, a vacuum space provided between the inner case and the outer case, with being maintained vacuum, to insulate the inner case from the outer case, and a porous filter filled in the vacuum space to restrain conductivity generated by gas existent in the vacuum space.

17 Claims, 5 Drawing Sheets

(56) References Cited

U.S. PATENT DOCUMENTS

| | | | | |
|---|---|---|---|---|
| 5,157,893 | A * | 10/1992 | Benson et al. | 52/789.1 |
| 5,175,975 | A * | 1/1993 | Benson et al. | 52/788.1 |
| 6,037,033 | A * | 3/2000 | Hunter | 428/72 |
| 6,073,944 | A | 6/2000 | Moore | |
| 6,257,684 | B1 | 7/2001 | Hirath | |
| 6,393,798 | B1 | 5/2002 | Hirath | |
| 6,479,112 | B1 * | 11/2002 | Shukuri et al. | 428/34 |
| 6,938,968 | B2 * | 9/2005 | Tanimoto et al. | 312/406 |
| 7,003,973 | B2 | 2/2006 | Lee | |
| 7,806,955 | B2 | 10/2010 | Wang | |
| 2001/0055478 | A1 | 12/2001 | Scherzer | |
| 2003/0167789 | A1 * | 9/2003 | Tanimoto et al. | 62/457.7 |
| 2005/0175809 | A1 * | 8/2005 | Hirai et al. | 428/69 |
| 2005/0200252 | A1 * | 9/2005 | Muller et al. | 312/401 |
| 2007/0214824 | A1 | 9/2007 | Itsuki | |
| 2011/0259040 | A1 | 10/2011 | Cataldo | |
| 2012/0060543 | A1 | 3/2012 | Hanley | |
| 2012/0104002 | A1 * | 5/2012 | Jung et al. | 220/592.27 |
| 2013/0029082 | A1 * | 1/2013 | Park | 428/69 |

FOREIGN PATENT DOCUMENTS

| | | | |
|---|---|---|---|
| CN | 2226260 | Y | 5/1996 |
| CN | 2241851 | Y | 12/1996 |
| CN | 1536305 | A | 10/2004 |
| CN | 2720362 | Y | 8/2005 |
| CN | 2777463 | Y | 5/2006 |
| CN | 101038121 | A | 9/2007 |
| CN | 101487652 | A | 7/2009 |
| CN | 101595340 | A | 12/2009 |
| CN | 101793455 | A | 8/2010 |
| EP | 1 835 242 | A2 | 9/2007 |
| WO | WO 2011/016693 | A2 | 2/2011 |

OTHER PUBLICATIONS

Chinese Office Action dated Jul. 7, 2014 for Chinese Application No. 2012104287779, with English Translation, 26 pages.

Chinese Office Action dated Jul. 24, 2014 for Chinese Application No. 201210432112.5, with English Translation, 21 pages.

Chinese Office Action dated Aug. 1, 2014 for Chinese Application. No. 201210433194.5, with English Translation, 17 pages.

U.S. Office Action dated Dec. 15, 2014 for U.S. Appl. No. 13/654,551, 11 pages.

U.S. Office Action (U.S. Appl. No. 13/655,677) dated Mar. 5, 2015, 18 pages.

U.S. Final Office Action dated Aug. 31, 2015, for U.S. Appl. No. 13/655,677, 37 pages.

* cited by examiner

REFRIGERATOR

CROSS-REFERENCE TO RELATED APPLICATION

This application claims priority under 35 U.S.C. §119 from Korean Application No. 10-2011-0113416 filed Nov. 2, 2011, the subject matter of which is incorporated herein by reference.

BACKGROUND

1. Field

Embodiments of the present invention relate to a refrigerator, more particularly, to a refrigerator including a vacuum space formed between an outer case and an inner case to improve an insulation function.

2. Background

A refrigerator is an electric home appliance can keep food stored in a storage compartment at a low temperature or a temperature below zero, using a refrigerant cycle.

A conventional configuration of such a refrigerator is provided with a case where a storage space is defined to store foods and a door rotatably or slidingly coupled to the case to open and close the storage space.

The case includes an inner case where the storage space is formed and an outer case configured to accommodate the inner case. An insulating material is arranged between the inner case and the outer case.

Such an insulating material suppresses the outdoor temperature from affecting an internal temperature of the storage space.

An example of the insulation material is urethane foams. Such urethane foams can be injection-foamed in the space formed between the inner and outer cases.

In this instance, to realize an insulation effect by using such the insulating material, a predetermined thickness of the insulating material has to be secured and that means that the insulating material becomes thick. Accordingly, a wall between the inner and outer cases becomes thick and the size of the refrigerator is increased as much as the thickness.

However, as a recent trend of a compact-sized refrigerator is on the rise, there is the need for the structure of the refrigerator that can make the volume of the internal storage space larger and the external size smaller.

SUMMARY

To solve the problems, an object of the invention is to provide a refrigerator that is able to improve an insulation effect by forming the vacuum space between the inner case and the outer case and to promote a compact volume.

Another object of the present invention is to provide a refrigerator that is able to form the vacuum space between the inner case and the outer case and that has a supporting structure to maintain the distance between the inner case and the outer case, without deformation of the inner and outer cases generated by an external shock.

A further object of the present invention is to provide a refrigerator that is able to reduce heat transfer conducted by rare gas existent in the vacuum space as much as possible.

To achieve these objects and other advantages and in accordance with the purpose of the embodiments, as embodied and broadly described herein, a refrigerator comprises an inner case that defines a storage space; an outer case spaced apart a distance from the inner case, the outer case and the inner case defining, between the outer case and the inner case, a vacuum space that is maintained at a partial vacuum pressure and that is configured to insulate the inner case from the outer case; and a porous filter that is located in the vacuum space defined between the outer case and the inner case and that is configured to restrain conductivity generated by gas present in the vacuum space.

The porous filter may comprise glass wool.

The porous filter may have a density of 65 kg/m3 or less.

An atmospheric pressure of the vacuum space may be 10-3 torr or less.

The distance between the inner case and the outer case may be approximately 10 mm.

The refrigerator may further comprise a getter that is located in the vacuum space and that is configured to absorb gas present in the vacuum space.

The refrigerator may further comprise a first support plate located at a surface of the inner case that faces the outer case; and a plurality of spacers fixed to the first support plate and configured to maintain the vacuum space between the inner case and the outer case.

The refrigerator may further comprise a second support plate located at a surface of the outer case that faces the first support plate.

The second support plate may comprise a plurality of grooves that are defined in an inner surface of the second support plate and that are configured to receive ends of the spacers therein.

The plurality of the grooves may be concavely curved.

The plurality of the grooves may be defined at positions corresponding to the spacers.

The plurality of the spacers may be uniformly arranged and spaced apart a predetermined distance from each other.

The refrigerator may further comprise a first support plate located at a surface of the outer case that faces the inner case; and a plurality of spacers fixed to the first support plate and configured to maintain the vacuum space between the inner case and the outer case.

The refrigerator may further comprise a second support plate located at a surface of the inner case that faces the first support plate.

The second support plate may comprise a plurality of grooves that are defined in an inner surface of the second support plate and that are configured to receive ends of the spacers therein.

The plurality of the grooves may be concavely curved.

The plurality of the grooves may be defined at positions corresponding to the spacers.

The inner case may define a refrigerating compartment.

The inner case may define a freezing compartment.

The inner case may define a refrigerating compartment and a freezing compartment.

The refrigerator according to embodiments has following advantageous effects. According to the refrigerator, the vacuum space is formed between the inner case and the outer case, instead of a conventional insulating material. Such the vacuum space performs the insulation to restrain heat transfer between the inner case and the outer case.

The insulation effect of the vacuum state is more excellent than the conventional insulating material. The refrigerator according to the present invention has an advantage of excellent insulation, compared with the conventional refrigerator.

Meanwhile, if the vacuum state of the vacuum space is maintained, the insulation function is performed, regardless of the thickness (the distance between the inner case and the outer case). However, the thickness of the conventional insulating material has to be larger to enhance the insulating effect and such increase of the thickness results in increase of the refrigerator size.

Accordingly, compared with the conventional refrigerator, the refrigerator according to the present invention can reduce the size of the outer case while maintaining the storage compartment with the same size. Accordingly, the present invention can be contributed to a compact sized refrigerator.

The refrigerator according to the present invention may minimize the heat transfer conducted by rare gas existent in the vacuum space formed between the inner case and the outer case. Accordingly, the refrigerator according to the present invention may have the good insulating effect.

Still further, the vacuum space is formed between the inner case and the outer case in the refrigerator according to the present invention. Together with that, the inner case and the outer case cannot be deformed by an external shock, with maintaining the distance.

The refrigerator according to the present invention may provide the structure which can facilitate the assembling work of the parts such as the inner and outer cases forming the vacuum space, the spacers provided between the inner and outer cases and the porous filter. Accordingly, workability of the refrigerator may be enhanced.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

Exemplary embodiments of the present invention will be described in detail, referring to the accompanying drawing figures which form a part hereof.

Figure 1:
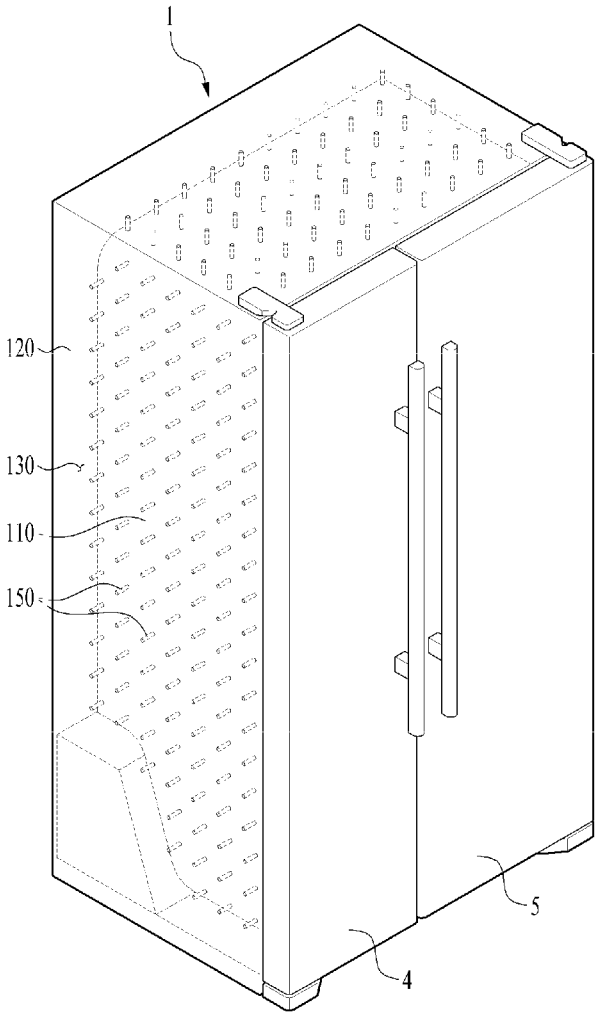
FIG. 1 is a perspective view of a refrigerator according to one embodiment of the present invention.
Figure 2:
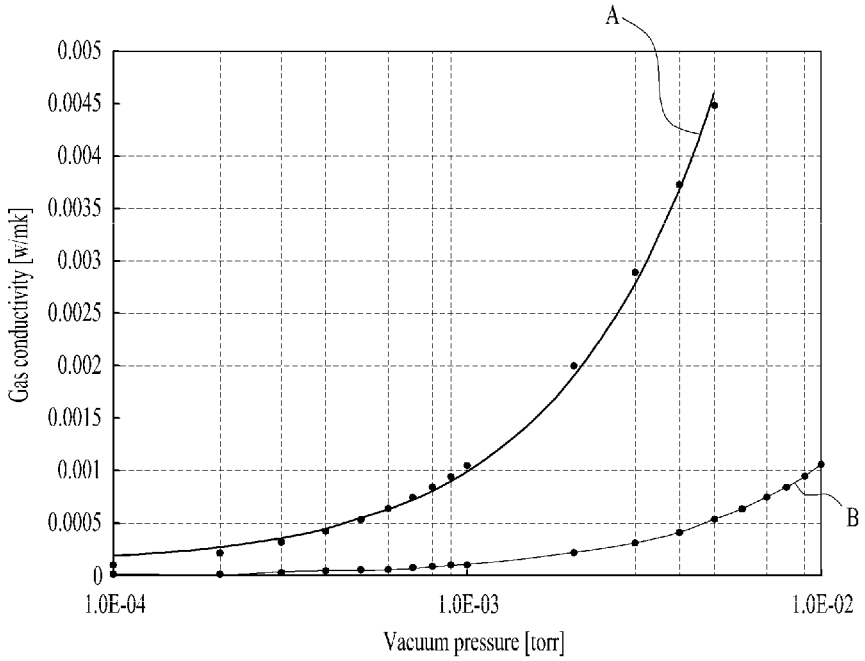
FIG. 2 is a graph showing gas conductivity according to an atmospheric pressure of a vacuum space formed between inner and outer cases provided in the refrigerator of FIG. 1.
Figure 3:
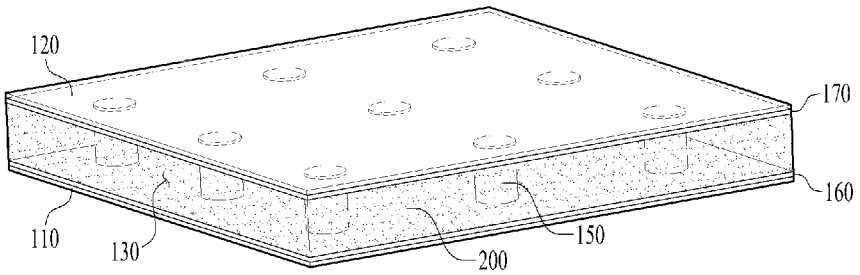
FIG. 3 is a partially cut-away perspective view illustrating the inner case, the outer case, a plurality of spacers and a porous filter that are provided in the refrigerator according to the embodiment of the present invention.

FIG. 1 illustrates a refrigerator according to one embodiment of the present invention. FIG. 2 illustrates a graph showing gas conductivity according to an atmospheric pressure of a vacuum space formed between inner and outer cases provided in the refrigerator of FIG. 1. FIG. 3 illustrates a partially cut-away perspective view of the inner case, the outer case, a plurality of spacers and a porous filter that are provided in the refrigerator according to the embodiment of the present invention.

As shown in FIG. 1, the refrigerator according to one embodiment of the present invention includes a case 1 in which a storage chamber is formed, a first door 4 rotatably coupled to a left side of the case 1 and a second door 5 rotatably coupled to right side of the case 1.

The first door 4 is configured to open and close a freezer compartment that consists of the storage compartment and the second door 5 is configured to open and close a refrigerator compartment that consists of the storage compartment. By nonlimiting example, the present invention may include various types of refrigerator.

In other words, the refrigerator shown in FIG. 1 is a side-by-side type having a refrigerator compartment arranged on the left and a freezer compartment arranged on the right. The refrigerator according to the present invention may be all types of refrigerators no matter how the refrigerator and freezer compartments are arranged. Also, the refrigerator may be a refrigerator only having a refrigerator or freezer compartment or a refrigerator having an auxiliary cooler compartment rather than the freezer and refrigerator compartments.

The structure of the case 1 includes an inner case 110 in which the storage space is formed, an outer case 120 accommodating the inner case, spaced apart a predetermined distance from the inner case, and a vacuum space 130 provided between the inner case and the outer case, with being closed to maintain a vacuum state to perform the insulation function between the inner case and the outer case.

The outer case 120 is spaced apart a predetermined distance from the inner case 110 and the vacuum space 130 is formed in the distance between the cases 120 and 110, to perform insulation.

In other words, the vacuum space 130 is formed between the outer case 120 and the inner case 110, to remove a medium that delivers the heat between the cases 110 and 120.

Accordingly, the heat from the hot air outside the outer case 120 can be prevented from being transmitted to the inner case as it is.

However, it cannot be clearly and absolutely said that no gas such as air and the like exist in the vacuum space 130. Gas having a pressure of approximately 0.1torr substantially exists in the vacuum space 130.

The heat can be transferred to the inner case 110 from the outside of the outer case 120 by conductivity of such rarely existent gas.

FIG. 2 shows the gas conductivity according to the vacuum pressure in the vacuum space 130 between the outer case 120 and the inner case 110.

In FIG. 2, 'A' refers to the thickness of the vacuum space 130, that is, the gas conductivity when the distance between the outer case 120 and the inner case 110 is 10 mm. 'B' refers to the gas conductivity when the thickness of the vacuum space 130 is 1 mm.

First of all, it is shown that the gas conductivity is getting lower as the atmospheric pressure is getting lower.

Also, it is shown that the gas conductivity is getting higher as the thickness of the vacuum space 130 is getting larger. If the gas conductivity reaches 0.001 W/mk, the atmospheric pressure has to be 0.001 torr or less in case of 'A' where the distance of the vacuum space is 10 mm.

Even if the atmospheric pressure has to be 0.01 torr in case of 'B' where the spaced distance of the vacuum space 130 is 1 mm, the gas conductivity is approximately 0.001 W/mk. However, the insulation function might be deteriorated by radiant heat transfer if the spaced distance of the vacuum space is 1mm and it is difficult to manufacture such the vacuum space. Accordingly, it is difficult to design the vacuum space having such the measurement.

As a result, there has to be formed an ultrahigh vacuum state where the atmospheric pressure has to be 0.001 torr or less to make the gas conductivity 0.001 W/mk with approximately 10 mm of the spaced distance between the cases, namely, the thickness of for the vacuum space 130.

It costs quite a lot to make the atmospheric pressure of the vacuum space 130 in such an ultrahigh vacuum state. It is more likely for the atmospheric pressure to be getting higher with time even in such the ultrahigh vacuum state. There is a disadvantage of the insulation function deteriorated quickly.

To solve such a disadvantage, the present invention provides a refrigerator including a vacuum space with the atmospheric pressure of the vacuum space 130 maintained relatively low and the gas conductivity lowered to 0.001 W/mk or less, to perform an insulation function.

The case 1 includes a porous filter 200 filled in the vacuum space 130 to limit the conductivity generated by gas existent in the vacuum space.

The porous filter 200 restrains action of gas molecules rarely existent in the vacuum space 130 to make the heat conductivity identical to the conventional heat conductivity at a lower vacuum gauge.

In other words, different from the prior art which requires a vacuum pressure of 0.001 torr or less in the vacuum space 130, the present invention may have the same insulation ability even at a vacuum pressure of 0.01 torr.

It is preferred that the porous filter 200 is formed of glass wool.

Such glass wool is cotton wool made of fiber glass. A high temperature inorganic dissolved substance exhausted from a nozzle is dispersed by a centrifugal force or high speed vapors to make it glass wool. Such the glass wool is compressed or combined with resin and molded and it is used for a lagging material or soundproof material.

According to the present invention, the glass wool as the porous filter 200 is filled at a relatively low density of 65 $kg/m^3$ or less, such that the conductivity generated by the rare gas can be reduced as much as possible.

Also, it is preferred that the pressure of the vacuum space 130 where the porous filter 200 is filled is maintained at $10^{-3}$ torr or less.

As mentioned above, if there is no porous filter in the vacuum space 130, the pressure of the vacuum space 130 has to be maintained at $10^{-3}$torr or less to realize a desired insulation performance. However, the desired insulation performance can be realized in the present invention, because the glass wool recues the conductivity generated by the gas. Accordingly, the desired insulation performance can be realized even at a relatively low vacuum gauge of $10^{-2}$ torr or less in the present invention.

Figure 4:
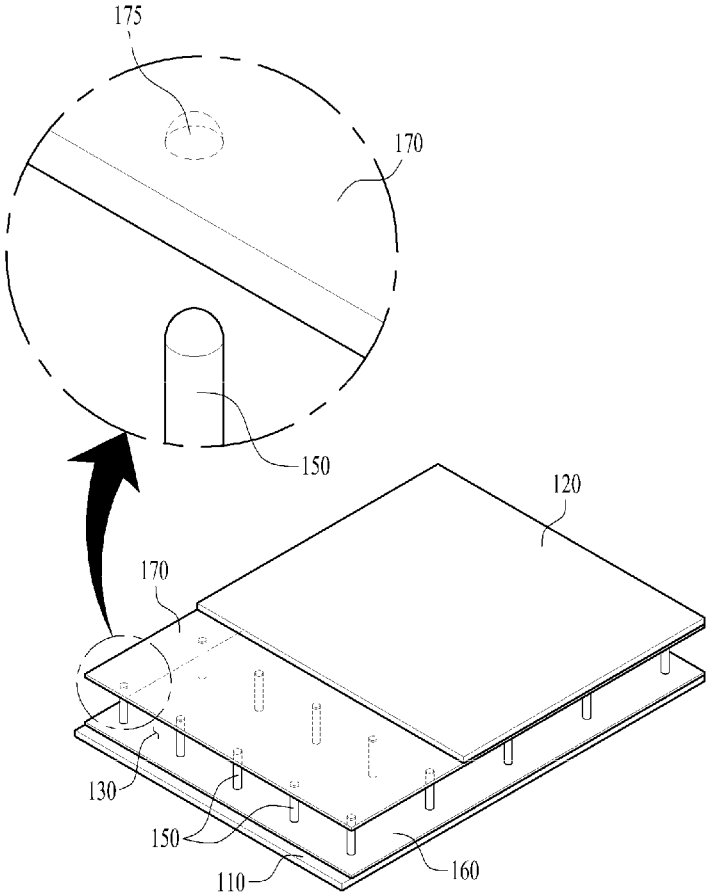
FIG. 4 is a partially cut-away perspective view illustrating the other various parts except the porous filter provided between the inner case and the outer case shown in FIG. 3.
Figure 5:
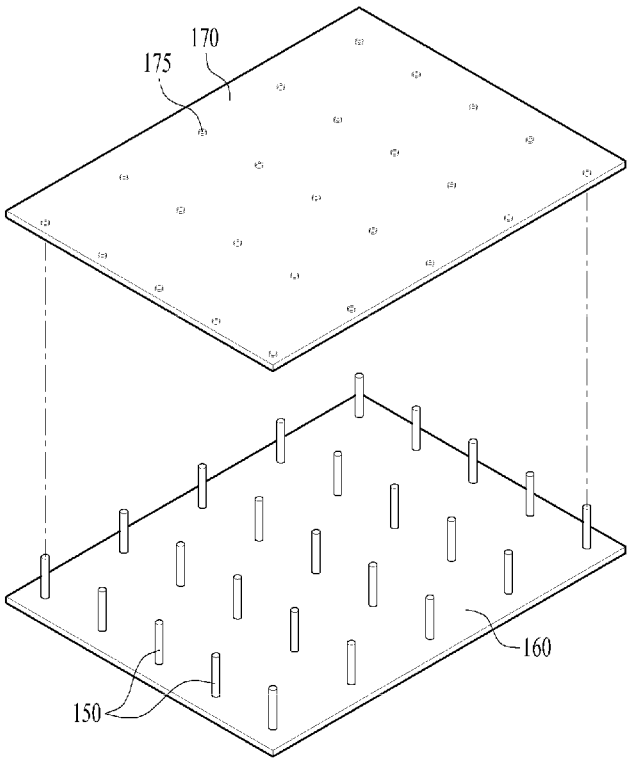
FIG. 5 is a perspective view illustrating an assembling process of a first support plate, the spacers and a second support plate shown in FIG. 4.

FIG. 3 partially shows the case including the porous filter 200 configured to restrain the conductivity generated by the gas existent in the vacuum space 130 provided between the inner case 110 and the outer case 120. FIG. 4 is a partially cut-away perspective view illustrating the other various parts except the porous filter provided between the inner case and the outer case shown in FIG. 3. FIG. 5 is a perspective view illustrating an assembling process of a first support plate, the spacers and a second support plate shown in FIG. 4.

The case 1 may further include a first support plate provided one of surfaces of the inner and outer cases 110 and 120 that face each other, and a plurality of spacers fixed to the first support plate to maintain a distance spaced apart between the inner case and the outer case.

The plurality of the spacers 150 may be arranged to maintain the distance between the inner case 110 and the outer case 120 to make the vacuum space 130 maintain its profile. Such the spacers 150 may support the first support plate to maintain the distance between the inner case 110 and the outer case 120.

The plurality of the spacers 150 may be fixed between the inner case 110 and the outer case 120. The plurality of the spacers 150 may be arranged in the first support plate 160 as a fixing structure.

The first support plate 160 may be provided in contact with one of facing surfaces possessed by the inner and outer cases 110 and 120.

In FIGS. 3 and 4, it is shown that the first support plate 160 is arranged to contact with an outer surface of the inner case 110. Optionally, the first support plate 160 may be arranged to contact with an inner surface of the outer case 120.

The case 1 may further include a second support plate 170 provided in the other one of facing surfaces possessed by the first and second cases 110 and 120, with facing the first support plate.

In the embodiment shown in FIGS. 3 and 4, the second support plate 170 is arranged to contact with the inner surface of the outer case 20 and the spacers 150 are fixedly arranged in the first support plate 160 to maintain a distance spaced apart between the first support plate 160 and the second support plate 170.

The first support plate 160 is in contact with the outer surface of the inner case 110 and the second support plate 170 is in contact with the inner surface of the outer case 120. Accordingly, the spacers 150 supportedly maintain the distance between the inner case 110 and the outer case 120.

In the embodiment shown in FIGS. 3 and 4, the second support plate 170 is spaced apart a predetermined distance from the first support plate 160. However, only the first support plate 160 where the spacers 150 are integrally fixed may be provided between the inner case 110 and the second case 120.

In case of no support plate 170 as mentioned above, ends of the spacers 150 may be arranged to directly contact with the inner surface of the outer case 120.

Meanwhile, for convenience sake, FIG. 1 shows only the inner case 110, the outer case 120 and the spacers 150, without the first support plate 160 and the second support plate 170.

Go back to the case where the second support plate 170 is provided together with the first support plate 160. The second support plate 170 may include a plurality of grooves formed in an inner surface thereof to insert ends of the spacers therein, respectively.

As shown in FIG. 4, the plurality of the grooves 175 formed in the second support plate 170 may facilitate the fixing of relative position with respect to the spacers 150, when the second support plate 170 is placed on the spacers 150 integrally formed with the first support plate 160.

The vacuum space 130 has to be formed between the inner and outer cases 110 and 120 composing the case 1. For instance, rim portions of the inner and outer cases 110 and 120 that form one surface of the case 1 have to be integrally formed with each other, with the corresponding size to the size of the one surface.

In contrast, first and second support plate units are fabricated, with a smaller size than the size of the inner or outer case 110 or 120. After that, sets of assembled first and second support plates having the spacers 150 positioned there between are fabricated and the sets of the assembled plates are inserted between the inner case 110 and the outer case 120.

Optionally, the first support plate 160 and the second support plate 170 are fabricated and assembled, with the same size as the inner and outer cases 110 and 120.

FIG. 4 partially illustrates the assembling between the inner case 110 and the outer case 120 in a multilayered structure, except the porous filter 200.

Hence, referring to FIG. 5, the structure and assembling method among the first support plate, the spacers and the second support plate will be described in detail.

As shown in the drawing, the plurality of the spacers 150 may be aligned in vertical and horizontal lines.

The plurality of the spacers 150 integrally formed with the first support plate 160 may be arranged in upward/downward and rightward/leftward lines, as shown in FIG. 5.

The plurality of the spacers 150 arranged in lines facilitates not only the design and molding fabrication process but also the assembly process. In addition, the plurality of the spacers arranged in lines may make the strength and rigidity stronger which endures the vacuum pressure or an external shock after the assembly process.

An end of each spacer 150 may be concavely curved.

As shown in a circle enlarged in FIG. 4, ends of the spacers 150 are concavely curved. In the assembly process, the end of each spacer 150 is easily seated in each groove 175 formed in the second support plate 170, only to ease the assembling work.

Moreover, it is more preferred that the plurality of the grooves 175 formed in the second support plate 170 are convexly curved, corresponding to the shape of the spacers 150.

The shapes of the grooves 175 formed in the second support plate 170 may be corresponding to the shapes of the spacers 150. Accordingly, it is easy to determine the positions of the spacers in the assembling work and the second support plate 170 can be fixed in parallel with the ends of the spacers, without movement.

The spacers 150, the first support plate 160 and the second support plate 170 may be formed of one of metal, ceramic and reinforced plastic.

The spacers 150 are provided in the vacuum space 130 formed between the inner case 110 and the outer case 120. The first support plate 160 and the second support plate 170 are in contact with the inner case 110 and the outer case 120, respectively.

Accordingly, the heat transfer from the outside of the outer case 120 into the inside of the inner case 110 has to be reduced as much as possible. External heat might be conducted via the second support plate 170, the spacers 150 and the first support plate 160.

It is preferred that the spacers 150, the first support plate 160 and the second support plate 170 provided between the inner case 110 and the outer case 120, in contact, are formed of one of metal, ceramic and reinforced plastic with a low heat conductivity.

The spacers and the like had better be formed of a material with a low heat conductivity and a good strength. It is more preferred that the above-mentioned components are formed of ceramic or reinforced plastic, not metal with a good strength but a relatively high heat conductivity.

The case 1 may further include a getter arranged in the vacuum space 130 to absorb the gas existent in the vacuum space.

Although not shown in the drawings, the getter is a material that absorbs the gas existent in the vacuum space 130 or makes a compound with the gas. The getter is classified into a contact getter and a dispersion getter based on a state of a material or a chemical activity level.

It is technically difficult for only a vacuum pump to maintain the desired vacuum gauge and it costs a lot. Because of that, the getter is used. The contact getter has strong adsorption and a solid state. The dispersion getter has a strong synthetic action and a gaseous state.

The getter is formed of active carbon, synthetic zeolite, quick lime, barium, magnesium, zirconium, red phosphorus and the like.

The getter is configured to have a pressure of $10^{-2}$ torr when the vacuum space 130 is fabricated in the refrigerator according to the present invention. The getter is configured to maintain the vacuum pressure in a relatively long time.

The vacuum space 130 is in a vacuum state but rare gas is existent in the vacuum space 130. There might constantly occur outgassing that solid elements are sublimated from the first support plate 160 and the second support plate 170 or the spacers 150 or the porous filter 200 by the vacuum pressure.

Accordingly, the getter absorbs the slowing increasing gas elements to maintain the desired vacuum pressure for a relatively long time.

A plurality of getters may be arranged according to the shape and volume of the vacuum space 130.

The getter may maintain the pressure in the vacuum space 130 at $10^{-2}$ torr and the porous filter 200 may minimize the conductivity generated by the gas. Also, the vacuum space 130 may minimize the conductivity generated via the solid or the space, only to maintain the high insulation performance.

According to the present invention, the glass wool as the porous filter is filled in the vacuum space provided between the inner case and the outer case. Accordingly, the conductivity generated by gas may be minimized even at a relatively low vacuum gauge and the insulation performance of the vacuum space may be improved in the refrigerator.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

an inner case that defines a storage space;

an outer case facing the inner case and spaced apart a distance from the inner case, the outer case and the inner case defining, between the outer case and the inner case, a vacuum space that is maintained at a vacuum pressure and that is configured to insulate the inner case from the outer case;

a porous filter that is located in the vacuum space defined between the outer case and the inner case and that is configured to restrain conductivity generated by gas present in the vacuum space;

a first support plate located at a surface of one of the inner case or the outer case;

a plurality of spacers fixed to the first support plate and configured to maintain the vacuum space between the inner case and the outer case; and a second support plate located at a surface of the other one of the inner case or the outer case, wherein the second support plate comprises a plurality of grooves that are defined on a surface of the second support plate and that are configured to receive ends of the spacers therein.

2. The refrigerator according to claim 1, wherein the porous filter comprises glass wool.

3. The refrigerator according to claim 1, wherein the porous filter has a density of 65 $kg/m^3$ or less.

4. The refrigerator according to claim 1, wherein an atmospheric pressure of the vacuum space is $10^{-3}$ torr or less.

5. The refrigerator according to claim 1, wherein the distance between the inner case and the outer case is approximately 10 mm.

6. The refrigerator according to claim 1, wherein the plurality of the grooves are concavely curved.

7. The refrigerator according to claim 1, wherein the plurality of the grooves are defined at positions corresponding to the spacers.

8. The refrigerator according to claim 1, wherein the plurality of the spacers are uniformly arranged and spaced apart a predetermined distance from each other.

9. The refrigerator according to claim 1, wherein the inner case defines at least one of a refrigerating compartment and a freezing compartment.

10. A refrigerator comprising:

an inner case defining a storage space;

an outer case facing the inner case and being spaced apart a distance from the inner case, the outer case and the inner case defining, between the outer case and the inner case, a vacuum space maintained at a vacuum pressure and being configured to insulate the inner case from the outer case;

a first support plate disposed on a surface of one of the inner case and the outer case, and in the vacuum space between the inner case and the outer case;

spacers disposed between the first support plate and the other one of the inner case and the outer case, each of the spacers having a cylindrical shape to maintain spacing between the inner case and the outer case, the spacers and the first support plate being integrated as a single part made from reinforced plastic; and a second support plate located at a surface of the other one of the inner case or the outer case, wherein the inner case and the outer case are made from metal and the second support plate comprises a plurality of grooves that are defined on a surface of the second support plate and that are configured to receive ends of the spacers therein.

11. The refrigerator of claim 10, wherein the spacers and the first support plate are integrated as a single part made from reinforced plastic.

12. The refrigerator of claim 10, wherein the spacers each have a cylindrical shape.

13. The refrigerator of claim 10, wherein an atmospheric pressure of the vacuum space is $10^{-3}$ torr or less.

14. The refrigerator of claim 10, wherein the spacers have concavely curved ends and the concavely curved ends of the spacers are configured to be received in the plurality of grooves.

15. The refrigerator of claim 10, wherein the first support plate is disposed directly on an outer surface of the inner case or an inner surface of the outer case.

16. The refrigerator of claim 15, wherein the second support plate is disposed directly on a surface of the other one of an outer surface of the inner case and an inner surface of the outer case.

17. The refrigerator of claim 10, wherein a size of the first support plate is smaller than a size of the inner case and smaller than a size of the outer case.

* * * * *